US010381763B2

(12) United States Patent
Ikegami

(10) Patent No.: US 10,381,763 B2
(45) Date of Patent: Aug. 13, 2019

(54) CONNECTOR

(71) Applicant: KYOCERA CORPORATION, Kyoto (JP)

(72) Inventor: Fumihito Ikegami, Funabashi (JP)

(73) Assignee: KYOCERA CORPORATION, Kyoto (JP)

( * ) Notice: Subject to any disclaimer, the term of this patent is extended or adjusted under 35 U.S.C. 154(b) by 0 days.

(21) Appl. No.: 15/753,937

(22) PCT Filed: Jun. 28, 2016

(86) PCT No.: PCT/JP2016/003109
§ 371 (c)(1),
(2) Date: Feb. 20, 2018

(87) PCT Pub. No.: WO2017/033382
PCT Pub. Date: Mar. 2, 2017

(65) Prior Publication Data

US 2018/0248288 A1 Aug. 30, 2018

(30) Foreign Application Priority Data

Aug. 26, 2015 (JP) ..... 2015-166885

(51) Int. Cl.
*H01R 12/79* (2011.01)
*H01R 12/88* (2011.01)

(52) U.S. Cl.
CPC ..... *H01R 12/88* (2013.01); *H01R 12/79* (2013.01)

(58) Field of Classification Search
USPC ..... 439/260, 495
See application file for complete search history.

(56) References Cited

U.S. PATENT DOCUMENTS 6,203,345 B1 * 3/2001 Roque ..... H01R 12/79 439/260
6,224,418 B1 * 5/2001 Miura ..... H01R 12/79 439/260

(Continued)

FOREIGN PATENT DOCUMENTS

JP 2002124331 A 4/2002
JP 2005196997 A 7/2005

(Continued)

OTHER PUBLICATIONS

International Search Report/Written Opinion dated Sep. 20, 2016, in counterpart Japanese International Application No. PCT/JP2016/003109 and Statement of Relevance of Non-English References.

*Primary Examiner* — Gary F Paumen
(74) *Attorney, Agent, or Firm* — Duane Morris LLP

(57) ABSTRACT

Provided is a connector that is capable of preventing breakage or dislocation of an actuator when an excessive force is applied to the actuator in an opening direction of the actuator, and also enables easy and reliable closing of the actuator during assembly of the actuator by an automatic assembling machine. An actuator (40) includes a pair of arms (40B) that are arranged on either side of an accommodation section (20A) and extending from either end of a pressing portion (40A) in an insertion direction of a connection object (12). The pair of arms (40B) and an insulator (20) include first open state restriction unit (40F, 23E) configured to restrict an opening angle of the actuator (40) from a closed state to an opened state.

9 Claims, 10 Drawing Sheets

(56) References Cited

U.S. PATENT DOCUMENTS 6,338,648 B1* 1/2002 Miura ..... H01R 12/79 439/260
6,352,442 B1* 3/2002 Kudo ..... H01R 12/88 439/260
6,431,907 B1* 8/2002 Ma ..... H01R 12/79 439/260
7,179,107 B2 2/2007 Shen et al.
7,179,118 B1* 2/2007 Harlan ..... H01R 12/774 439/260
2003/0060072 A1* 3/2003 Miura ..... H01R 12/79 439/260
2005/0260885 A1* 11/2005 Lu ..... H01R 12/79 439/495
2007/0020982 A1 1/2007 Shen et al.
2008/0081501 A1* 4/2008 Hemmi ..... H01R 12/79 439/329
2008/0242143 A1* 10/2008 Tanaka ..... H01R 12/79 439/499
2009/0298319 A1* 12/2009 Takahashi ..... H01R 4/028 439/329
2010/0068919 A1* 3/2010 Taketomi ..... H01R 12/79 439/499
2013/0023142 A1* 1/2013 Sasaki ..... H01R 12/592 439/325
2013/0267110 A1* 10/2013 Kajiura ..... H01R 12/72 439/329
2015/0056844 A1* 2/2015 Takane ..... H01R 12/79 439/372
2016/0294091 A1* 10/2016 Asanuma ..... H01R 12/778
2017/0331206 A1* 11/2017 Manba ..... H01R 12/79
2018/0034174 A1* 2/2018 Yamaguchi ..... H01R 12/7005
2018/0166816 A1* 6/2018 Takemoto ..... H01R 12/79

FOREIGN PATENT DOCUMENTS

JP 3124245 U 7/2006
JP 2011222269 A 11/2011
JP 2012226947 A 11/2012
JP 2013175395 A 9/2013
JP 2016-110902 A 6/2016

* cited by examiner

CONNECTOR

CROSS REFERENCE TO RELATED APPLICATION

This application claims priority to and the benefit of Japanese Patent Application No. 2015-166885 filed on Aug. 26, 2015, the entire contents of which are incorporated herein by reference.

TECHNICAL FIELD

The present disclosure relates to a connector.

BACKGROUND

A conventional connector for connection to a connection object having a flat-plate shape such as FPC (Flexible Printed Circuit) or FFC (Flexible Flat Cable) is disclosed, for example, in PLT 1 set forth below. This connector includes an insulator that allows insertion and removal of the connection object, a contact fixed to the insulator, and an actuator rotatably (openably and closably) supported by the insulator. To facilitate insertion of the connection object by a person, this actuator may rotate at least 90 degrees from its closed state as far as a top surface (a rear surface) of the actuator and an end portion of a top surface of the insulator contact each other (see FIG. 2 of the PLT 1). To connect the connection object to the connector, a person opens the actuator to an open state, inserts the connection object into the connector, and then closes the actuator.

CITATION LIST

Patent Literature

PLT 1: JP-A-2002-124331

SUMMARY

Technical Problem

Here, in the above conventional connector, the actuator may rotate at least 90 degrees from the closed state and, when an opening angle exceeds 90 degrees, the actuator falls backward (hereinafter, referred to as a "backward-falling state").

Thus, when a person inadvertently applies, to the actuator, a force to open the actuator exceeding a maximum opening angle that causes the backward-falling state, the top surface (the rear surface) of the actuator and the end portion of the top surface of the insulator interfere (collide) with each other. As a result, the actuator may break or may be dislocated.

Recently, also, insertion of the connection object into the connector and connection therebetween are widely automated using an assembling machine in an assembly line. The tendency towards such automation is expected to further accelerate in the future. In this case, in order to cause transition of the actuator from the backward-falling state to the closed state, the actuator needs to be rotated by at least 90 degrees and a force to push the actuator in a closing direction thereof is required (a force to press down from above the connector). However, current assembling machines typically have a problem in that the press down force applied to the actuator from above the connector tends to be insufficient, and incomplete operation (locking) can easily occur. Also, an additional step is necessary to securely press down on the actuator from above the connector, which tends to lead to negative effects such as an increase in size or cost of the assembling machine and congestion in the assembly line.

In light of the above problems, it would be helpful to provide a connector capable of preventing breakage or dislocation of the actuator caused by excessive force applied in an opening direction of the actuator and enable easy and reliable closing of the actuator during assembly by an automated assembling machine.

Solution to Problem

A connector according to the present disclosure includes: an insulator including an accommodation section with an accommodation opening and configured to allow insertion of a connection object through the accommodation opening; a contact supported by the insulator and electrically connectable to the connection object in the accommodation section; and an actuator that is supported by the insulator in an openable and closable manner, enables insertion of the connection object through the accommodation opening when in an open state, and includes a pressing portion configured to press the connection object in the accommodation section to the contact when in a closed state. The actuator includes a pair of arms located on either side of the accommodation section and extending in an insertion direction of the connection object from either end of the pressing portion. The pair of arms and the insulator include a first open state restriction unit configured to restrict an opening angle of the actuator from the closed state to the open state.

The first open state restriction unit may be configured with a pair of abutments provided to the pair of arms and the insulator. The pair of abutments is configured to contact each other when the actuator is in the open state to restrict the opening angle of the actuator.

The pair of abutments of the first open state restriction unit do not contact each other when the actuator is in the closed state.

The abutments of the pair of arms may be at least partially located farther in the insertion direction of the connection object than a top end of the pressing portion in the insertion direction.

A distance between the top end of the pressing portion in the insertion direction and the abutments of the pair of arms may be set to be longer than a distance between a top surface of the accommodation section and the abutment of the insulator.

The pressing portion and the insulator may include a second open state restriction unit configured to restrict the opening angle of the actuator from the closed state to the open state.

The second open state restriction unit may be configured with a recess formed on the pressing portion and a projection formed on the insulator that are facing each other.

A lateral projection protruding in a lateral direction from the pair of arms is formed on the pair of arms of the actuator The insulator may be supported by a retaining bracket that is configured to accommodate the lateral projections of the pair of arms and to enable the actuator to rotate and slide relative to the insulator.

The lateral projection and the retaining bracket may include a third open state restriction unit configured to restrict the opening angle of the actuator from the closed state to the open state.

The third open state restriction unit may be configured with the lateral projection and an inclined surface that is formed on the retaining bracket and remote farther from a bottom surface of the accommodation section as located farther in the insertion direction.

The connection object may include a positioning recess formed thereon. The insulator may include a positioning projection to fit in the positioning recess when the actuator is in the closed state.

Advantageous Effect

The connector according to the present disclosure is capable of preventing breakage or dislocation of the actuator caused by an excessive force applied in an opening direction of the actuator and enables easy and reliable closing of the actuator during assembly by an automated assembling machine.

DETAILED DESCRIPTION

Figure 1:
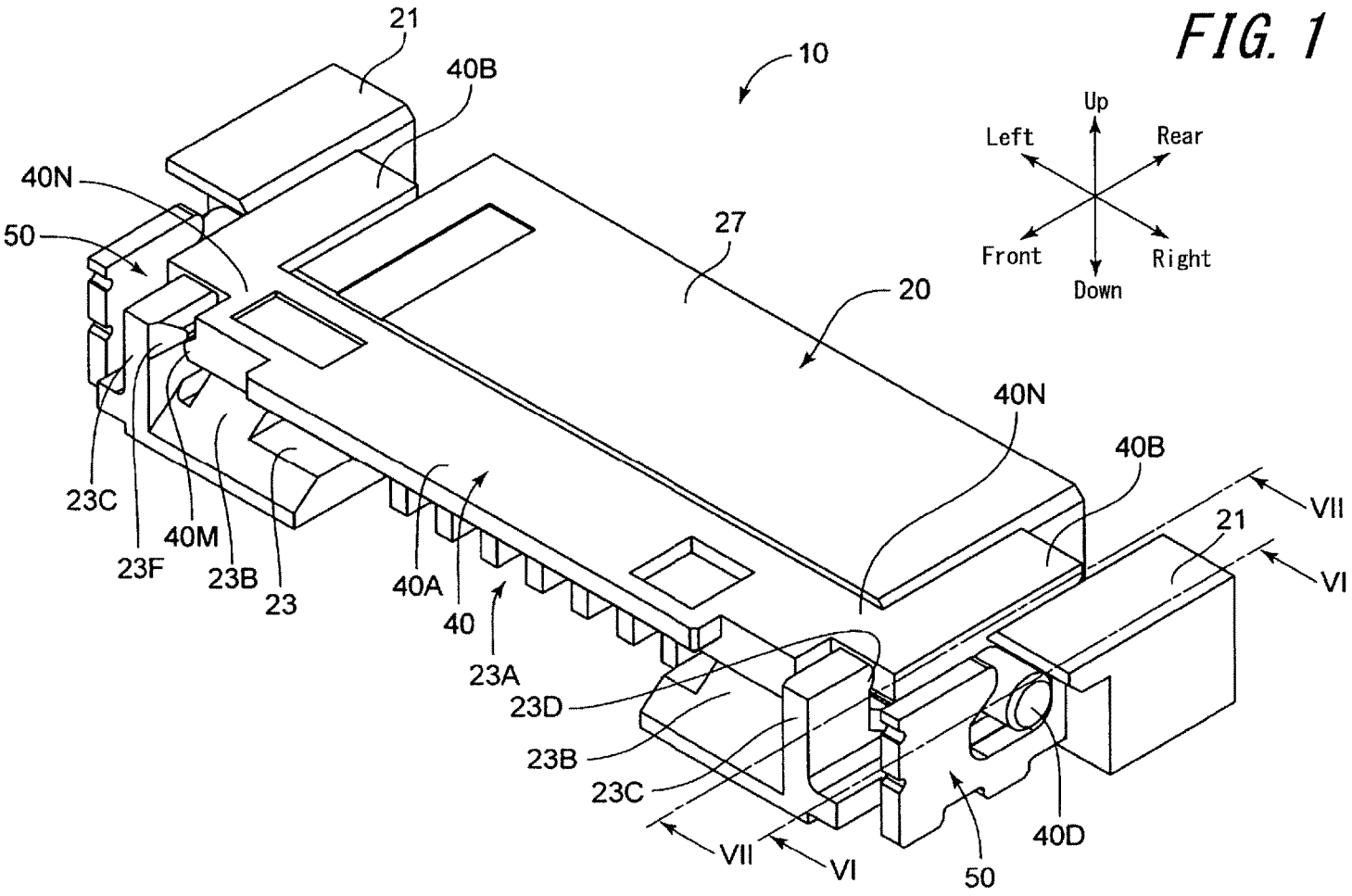
FIG. 1 is a perspective view illustrating a configuration of a connector according to an embodiment (closed state)

Hereinafter, a connector 10 according to an embodiment will be described with reference to FIG. 1 to FIG. 13. The connector 10 allows insertion and removal of a connection object 12 (e.g., FPC) illustrated in FIG. 5. In the following description, directions (front-rear, up-down, and left-right directions) correspond to the directions indicated by arrows in the figures. The front-rear direction in the figures corresponds to an "insertion-removal direction of the connection object 12". A rearward direction in the figures corresponds to an "insertion direction of the connection object 12." A forward direction in the figures corresponds to a "removal direction of the connection object 12".

Configuration of Connector 10

The connector 10 includes an insulator 20 extending in the left-right direction, a plurality of contacts 30 arranged in a row and supported by the insulator 20, an actuator 40 provided in an openable and closable manner (rotatably) relative to the insulator 20, and two retaining brackets 50 configured to prevent removal (dislocation) of the actuator 40 from the insulator 20.

Figure 5:
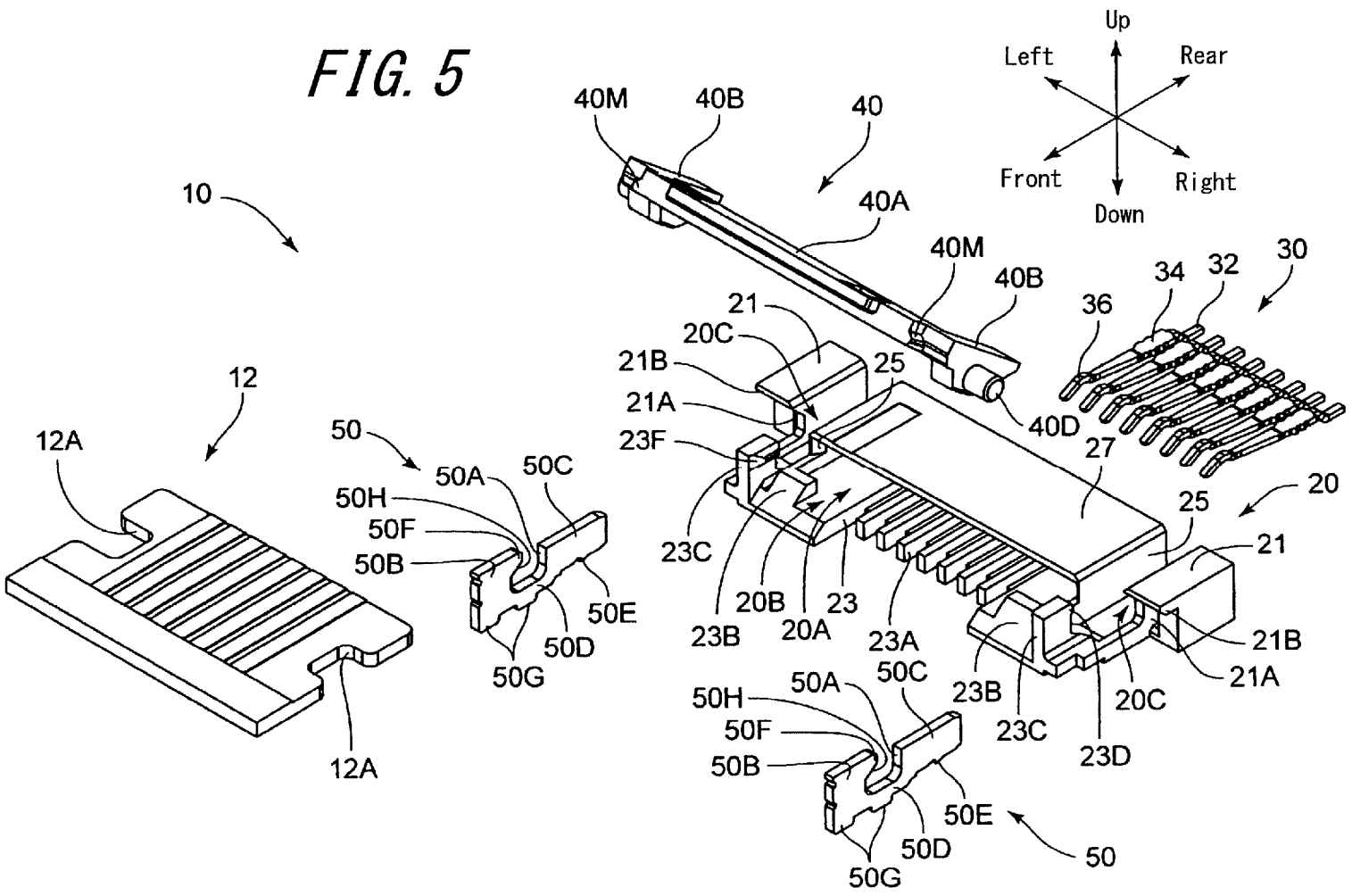
FIG. 5 is an exploded perspective view of the connector according to the embodiment.

As illustrated in FIG. 5, the contact 30 is made of metal and includes, at its rear end, mounting portions 32 bent in a substantially L-shape. The contact 30 also includes elastic deformable portions 34 located on a front side of the mounting portions 32 and extending obliquely upward in the forward direction. Near the front ends of the elastic deformable portions 34, contact projections 36 which bend upwards are provided. The mounting portions 32 are soldered to a pattern provided on a substrate 14 (see FIG. 11 to FIG. 13).

The insulator 20 is made of resin material having electric insulating properties. The insulator 20 includes fitting bracket locking blocks 21 having fitting bracket locking holes 21A formed on either lateral end thereof and extending in the front-rear direction, and a bottom plate 23 having a flat-plate shape extending in the left-right direction and connecting the fitting bracket locking blocks 21 together. At upper end of the fitting bracket locking block 21 above the fitting bracket locking hole 21A, an actuator retaining projection 21B is provided protruding forward.

On a top surface of the bottom plate 23 of the insulator 20, a plurality of contact locking grooves 23A are formed extending in the front-rear direction and parallel to each other. The contacts 30 are pressed into and fixed in corresponding contact locking grooves 23A (see FIG. 2 and FIG. 3).

On the top surface of the bottom plate 23, also, a pair of side walls 25 rising upwards are formed at a position remote from the fitting bracket locking block 21 in a manner holding the plurality of contact locking grooves 23A from the left and right sides thereof. Upper ends of the pair of side walls 25 are connected to each other via a top plate 27 having a flat-plate shape. Rear ends of the pair of side walls 25 are connected to each other via a rear surface 29 having a flat-plate shape (see FIG. 4). The rear surface 29 includes contact insertion holes 29A at positions corresponding to the plurality of contact locking grooves 23A (see FIG. 4). Each of the contact insertion holes 29A is in communication with the corresponding contact locking grooves 23A. The contacts 30 inserted from the contact insertion holes 29A are locked and fixed in the contact insertion holes 29A and the contact locking grooves 23A.

A space surrounded by the bottom plate 23, the pair of side walls 25, the top plate 27, and the rear surface 29 constitutes a connection object accommodation section 20A (an accommodation section) configured to accommodate a connection object 12. The connection object 12 may be inserted into or removed from the connection object accommodation section 20A through the accommodation opening 20B on the front side of the connection object accommodation section 20A.

Figure 2:
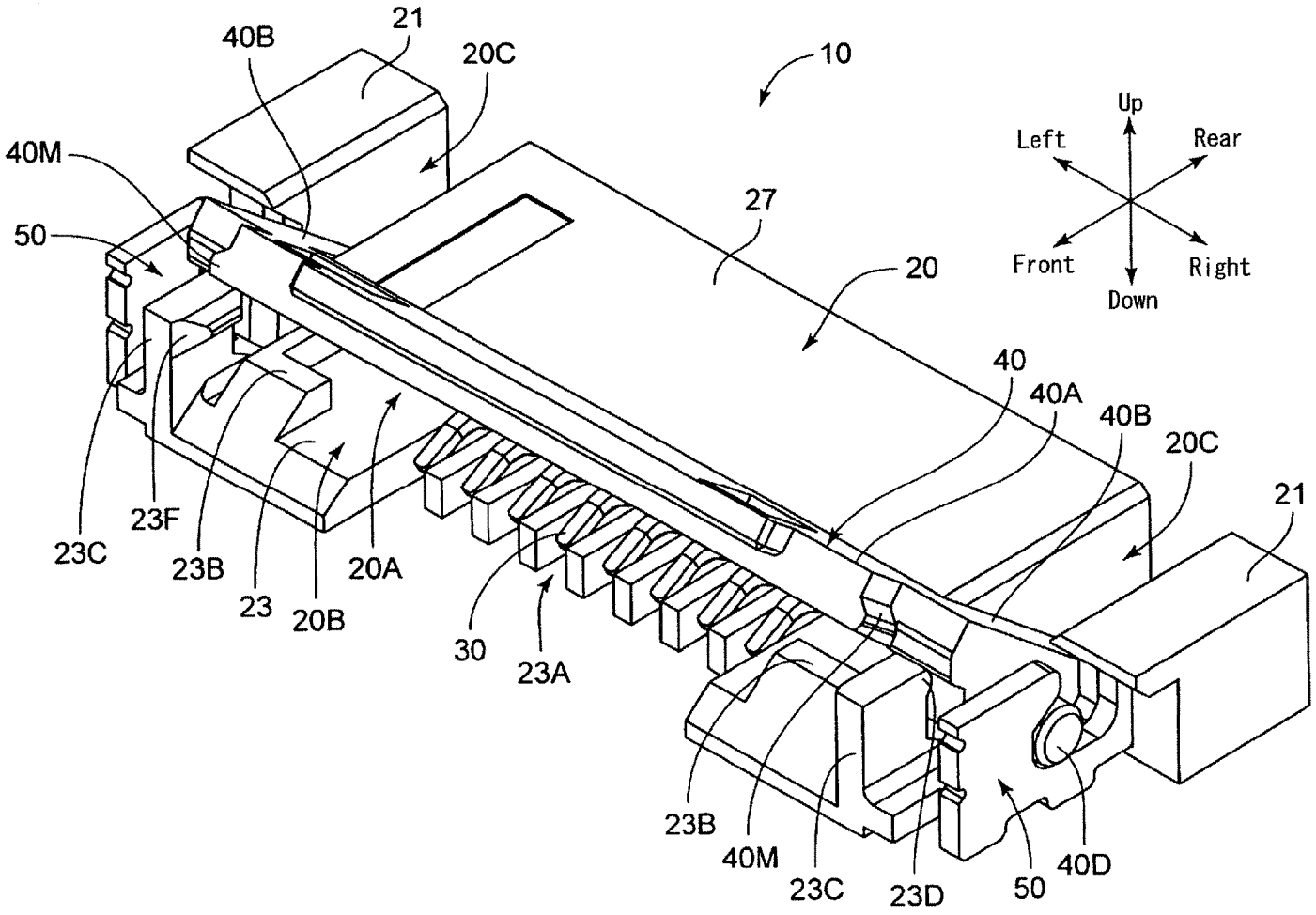
FIG. 2 is a perspective view illustrating the configuration of the connector according to the embodiment (open state)
Figure 4:
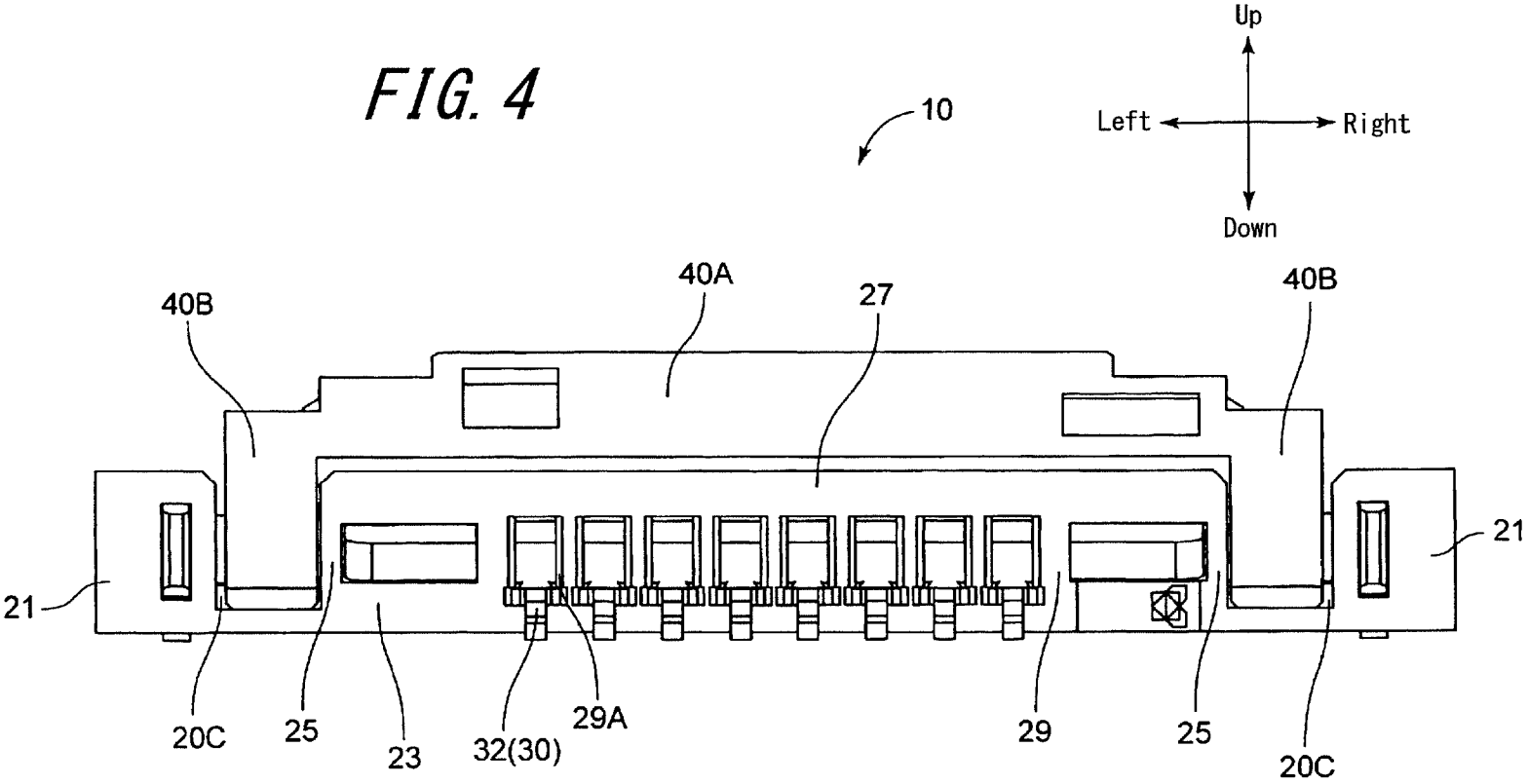
FIG. 4 is a diagram illustrating the connector according to the embodiment viewed from a rear side thereof (open state)

A pair of arm accommodation recesses 20C is formed between the side wall 25 of the connection object accommodation section 20A and a side wall of the fitting bracket locking block 21 at the left and right ends of the bottom plate 23 (see FIG. 2, FIG. 4, and FIG. 5).

A pair of retaining projections 23B (a pair of positioning projections) is formed rising upwards on an upper surface of the bottom plate 23 in front of the left and right ends of the connection object accommodation section 20A to prevent dislocation of the connection object 12 from the connection object accommodation section 20A. When engaging cutouts 12A (positioning cutouts) formed at left and right ends of the connection object 12 are engaged with (accommodate) the pair of retaining projections 23B, an inserting position of the connection object 12 is determined, and the connection object 12 is prevented from becoming dislocated from the connection object accommodation section 20A.

A pair of guiding projections 23C is provided on the upper surface of the bottom plate 23 laterally outside the pair of retaining protrusions 23B. Guiding surfaces 23D which are arcuate in shape are formed at upper portions of the rear surfaces the pair of guiding projections 23C to guide the transition of the actuator 40 between the open state and the closed state (see FIG. 1, FIG. 5, FIG. 7, and FIG. 9).

Figure 3:
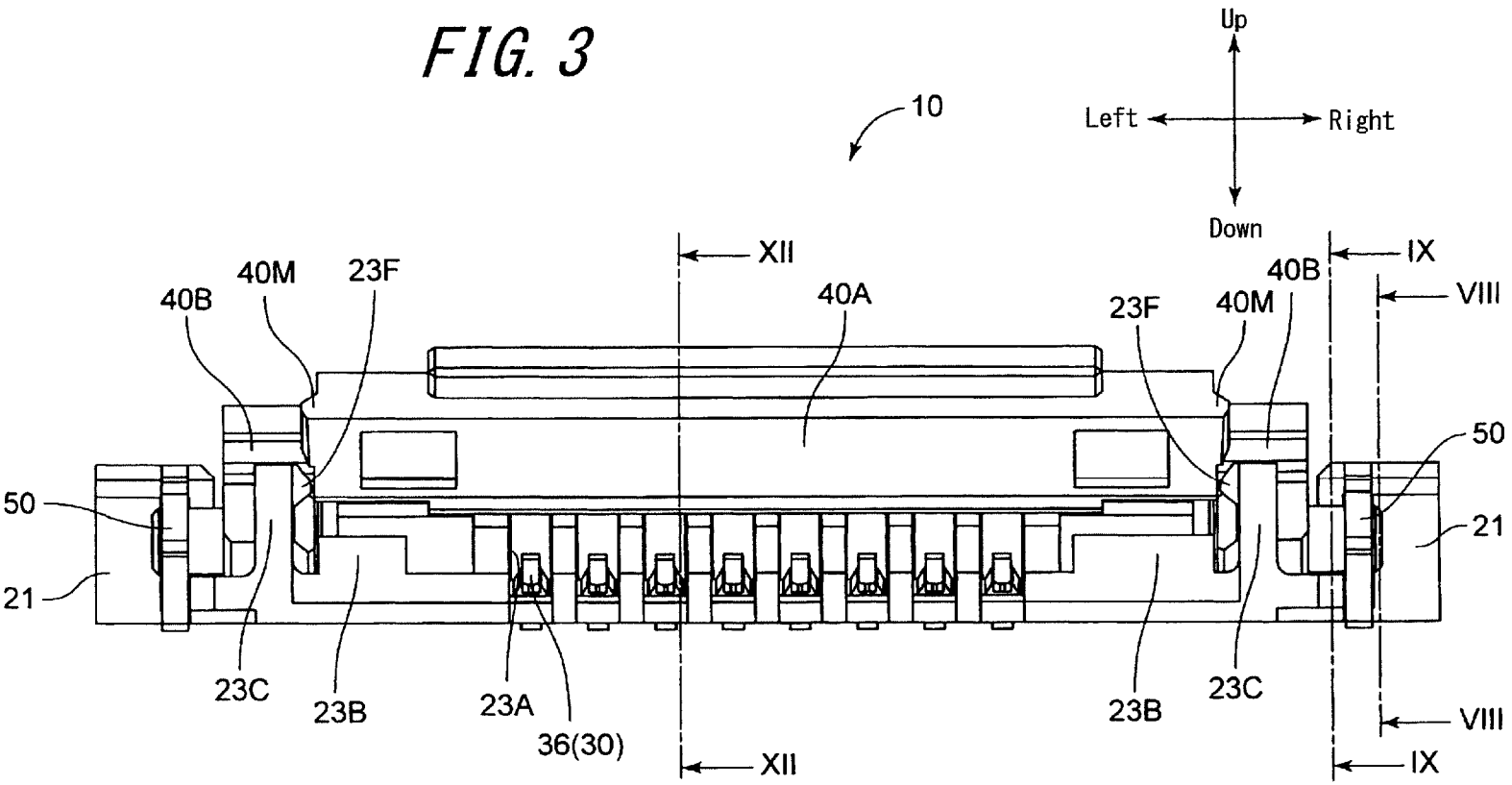
FIG. 3 is a diagram illustrating the connector according to the embodiment viewed from a front side thereof (open state)
Figure 11:
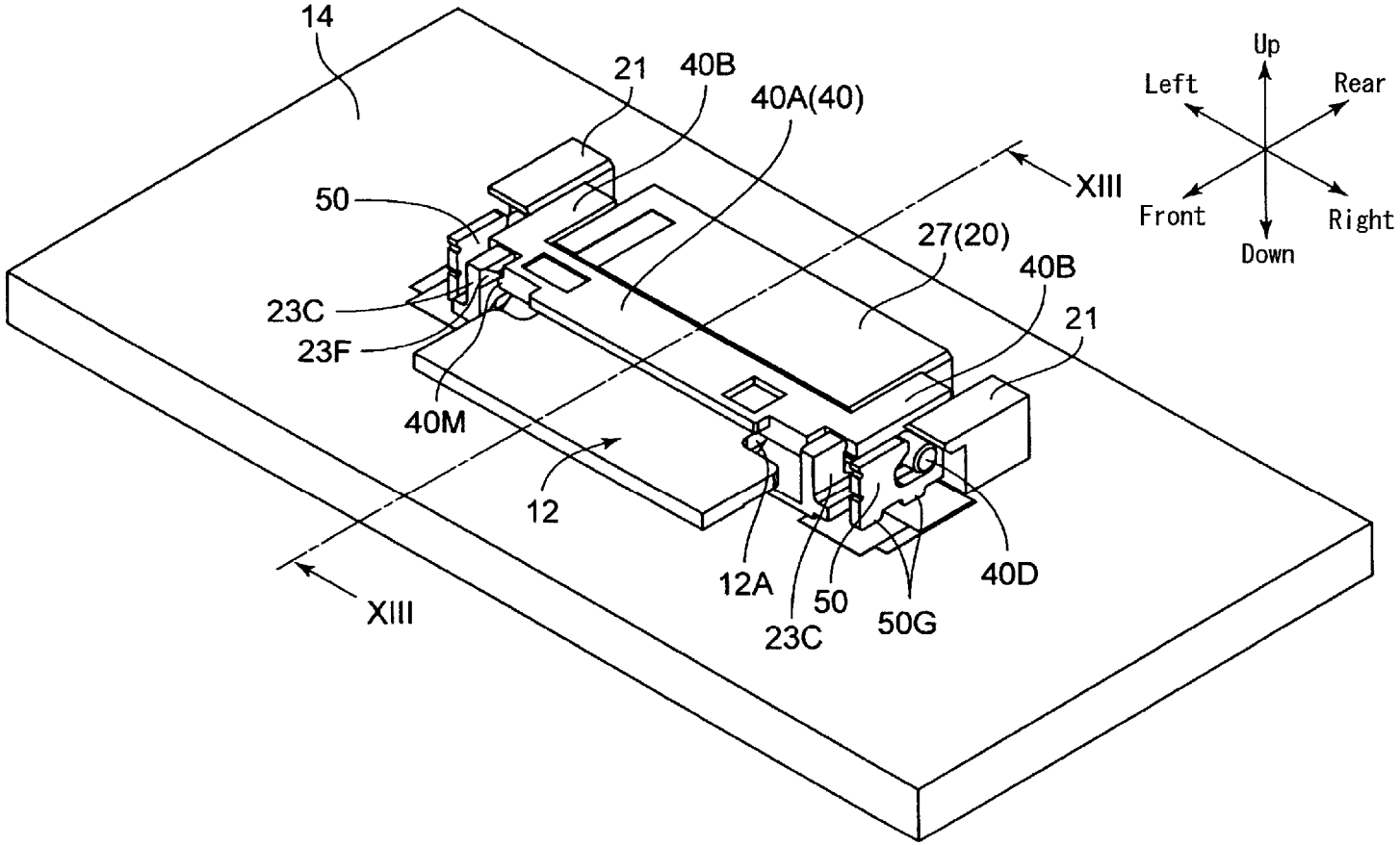
FIG. 11 is a second diagram illustrating the mounting of the connector and the connection of the connection object to the connector.

Also, engaging projections 23F which face each other are provided at upper end portions of lateral surfaces of the pair of guide projections 23C (see FIG. 3, FIG. 5, and FIG. 11).

A top surface of the bottom plate 23 includes supporting abutments 23E configured to contact a rear end abutment 40F of an inclined surface 40I of the actuator 40 when the actuator 40 is in the open state, which will be described later (see FIG. 9). The supporting abutments 23E are located laterally outside of the pair of side walls 25 of the insulator 20 (i.e., two regions of the bottom plate 23 between the side walls 25 and the fitting bracket locking blocks 21). Functions and effects of the rear end abutment 40F and the supporting abutments 23E will be described in detail later.

A projection 27A, which faces a recess 40C of the actuator when the actuator 40 is in the open state, is formed at a front end of the top plate 27 (see FIG. 13), which will be described later. Functions and effects of the recess 40C and the projection 27A will be described later in detail.

The actuator 40 is supported by the insulator 20 in the openable and closable manner and enables the insertion and removal of the connection object 12 through the accommodation opening 20B in the open state. Also, the actuator 40 includes an actuator base portion 40A (a pressing portion) having a flat-plate shape configured to press the connection object 12 accommodated in the connection object accommodating section 20A to the contact 30 in the closed state. Further, the actuator 40 includes the pair of arms 40B located on either lateral side of the connection object accommodating section 20A of the insulator 20 and extending in the front-rear direction (in the insertion-removal direction of the connection object 12) from either lateral ends of the actuator base portion 40A. The pair of arms 40B is accommodated in the pair of arm accommodating recesses 20C of the insulator 20.

The actuator base portion 40A also includes, on a front side of the pair of arms 40B, engaging projections 40M formed on the left and right end portions 40N and protruding in the left-right directions. The engaging projections 40M engage with the engaging projections 23F of the insulator 20 when the actuator 40 is in the closed state.

Figure 12:
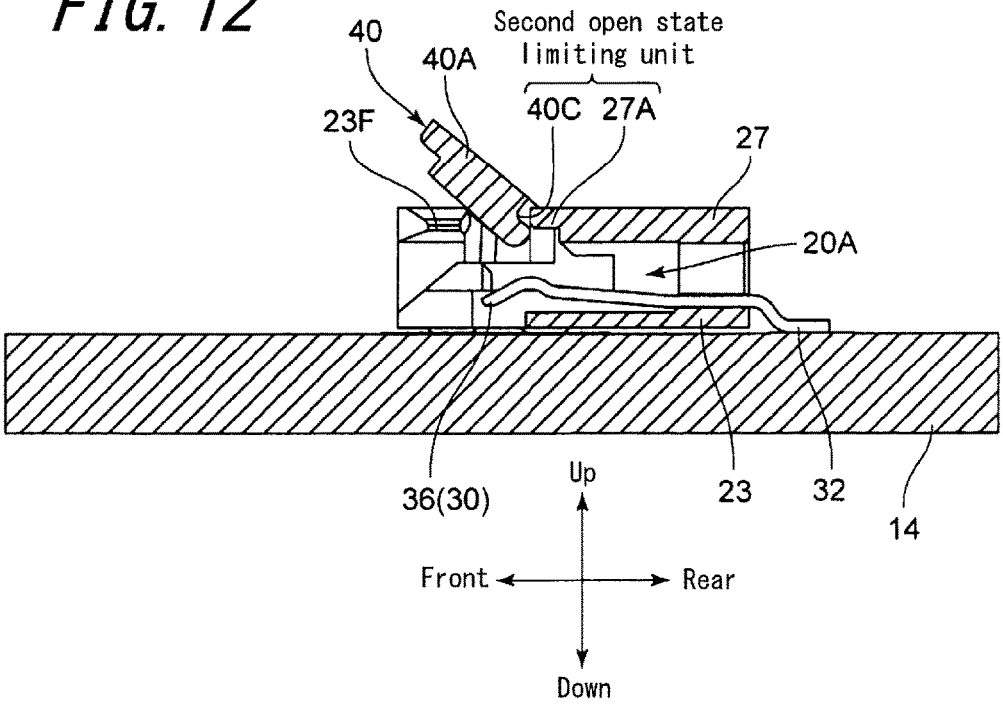
FIG. 12 is a cross-sectional view taken from line XII-XII of FIG. 3.
Figure 13:
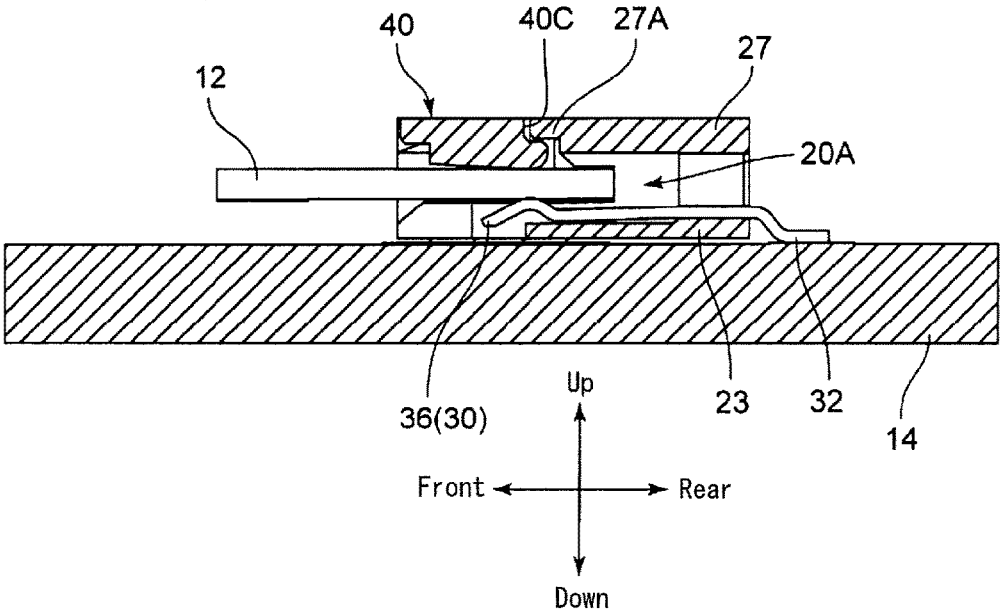
FIG. 13 is a cross-sectional view taken from line XIII-XIII of FIG. 11.

At a rear end 40E of the actuator base portion 40A (at a top end thereof in the insertion direction) (see FIG. 9), a recess 40C is formed opening upward and rearward (see FIG. 12 and FIG. 13). The pair of arms 40B each includes a movement restriction projection 40D (a lateral projection) having a cylindrical shape projecting leftward or rightward. The movement restriction projection 40D is located between the rear end 40E of the actuator base portion 40A and a rear end abutment 40F formed at a rear end of the inclined surface 40I of the actuator 40. In other words, the movement restriction projection 40D is located within a distance L1 between the rear end 40E of the actuator base portion 40A and the rear end abutment 40F of the pair of arms 40B, as illustrated in FIG. 9.

Figure 7:
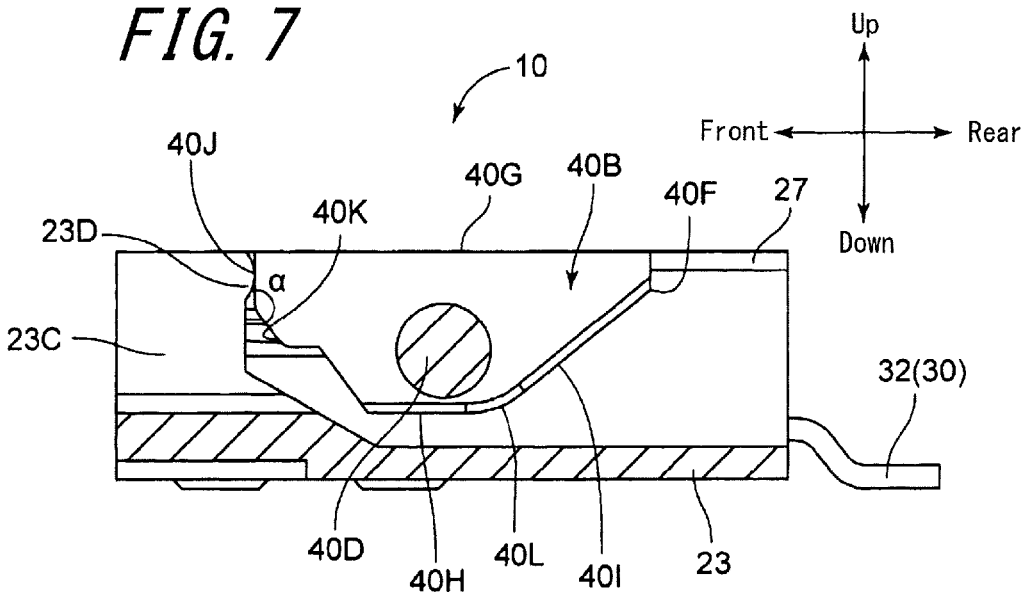
FIG. 7 is a cross-sectional view taken from line VII-VII of FIG. 1.

As illustrated in FIG. 7, when viewed in the left-right direction, the arm 40B of the actuator 40 has a substantial trapezoidal shape including a top surface 40G, a bottom surface 40H, and an inclined surface 40I connecting a rear end of the top surface 40G and a rear end of the bottom surface 40H together. In the substantial trapezoidal shape, a portion connecting between a front end of the top surface 40G and a front end of the bottom surface 4014 includes a step formed by a first guided portion 40J and a second guided portion 40K forming an internal angle $\alpha$ larger than 90 degrees together with the first guided portion 40J. As illustrated in FIG. 7, when the actuator 40 is in the closed state, the top surface 40G and the bottom surface 40H are substantially parallel to the bottom plate 23 of the insulator 20 and, simultaneously, the bottom surface 40H is spaced apart from the bottom plate 23. When the actuator 40 is in the closed state, also, the first guided portion 40J faces the guiding surface 23D of the insulator 20. The bottom surface 40H and the inclined surface 40I are connected to each other via a ridge 40L (a curved portion).

The retaining bracket 50 is formed by shaping a flat metal plate and includes, near a center thereof in the front-rear direction, an open-top cutout 50A opening upward and in the left-right direction (see FIG. 5). The open-top cutout 50A has a width in the front-rear direction that is smaller in the upper portion than in the lower portion. The width in the upper portion is larger than a diameter of the movement restriction projection 40D of the actuator 40. The retaining bracket 50 includes a fitting bracket base portion 50B located on a front side of the open-top cutout 50A, an insertion portion 50C located on a rear side of the open-top cutout 50A and inserted into the fitting bracket locking hole 21A of the fitting bracket locking block 21, and a connecting portion 50D located below the open-top cutout 50A and configured to connect between the metal base portion 50B and the insertion portion 50C at their lower portions.

Near a center of the insertion portion 50C in the front-rear direction, a locking projection 50E protrudes downward from a bottom surface of the insertion portion 50C. When the insertion portion 50C is inserted into the fitting bracket locking hole 21A of the fitting bracket locking block 21, the locking projection 50E is locked to a bottom surface of the fitting bracket locking hole 21A and prevented from becoming dislocated.

At an upper rear portion of the fitting bracket base portion 50B, an actuator retaining projection 50F is formed protruding rearward. An upper surface of the fitting bracket base portion 50B and an upper surface of the actuator retaining projection 50F together form one flat plane. A height of this flat plane in the up-down direction is higher than an upper surface of the insertion portion 50C. When the insertion portion 50C is inserted into the fitting bracket locking hole 21A of the fitting bracket locking block 21, a rear end of the actuator retaining projection 50F and a front end of the actuator retaining projection 21B of the fitting bracket locking block 21 face each other with a space therebetween smaller than the diameter of the movement restriction projection 40D of the actuator 40 having a cylindrical shape. Thus, the actuator 40 is prevented from becoming dislocated from the retaining bracket 50 (the insulator 20) (see FIG. 6).

The bottom surface of the fitting bracket base portion 50B and the bottom surface of the connecting portion 50D are each provided with a mounting portion 50G that protrudes downward (see FIG. 5). The mounting portion 50G is soldered to the pattern provided on the substrate 14 (see FIG. 11 to FIG. 13).

As is apparent from FIG. 6 and FIG. 8, an including surface 50H for which the distance from the lower surface portion (the bottom plate 23) increases in the rear direction (the insertion direction) is formed below the actuator retaining protection 50F. In other words, the inclined surface 50H substantially extends toward a front end of the actuator retaining projection 21B of the insulator 20.

Operation of Connector 10

When the actuator 40 is in the open state, the connector 10 configured as described above operates in the following manner.

Figure 9:
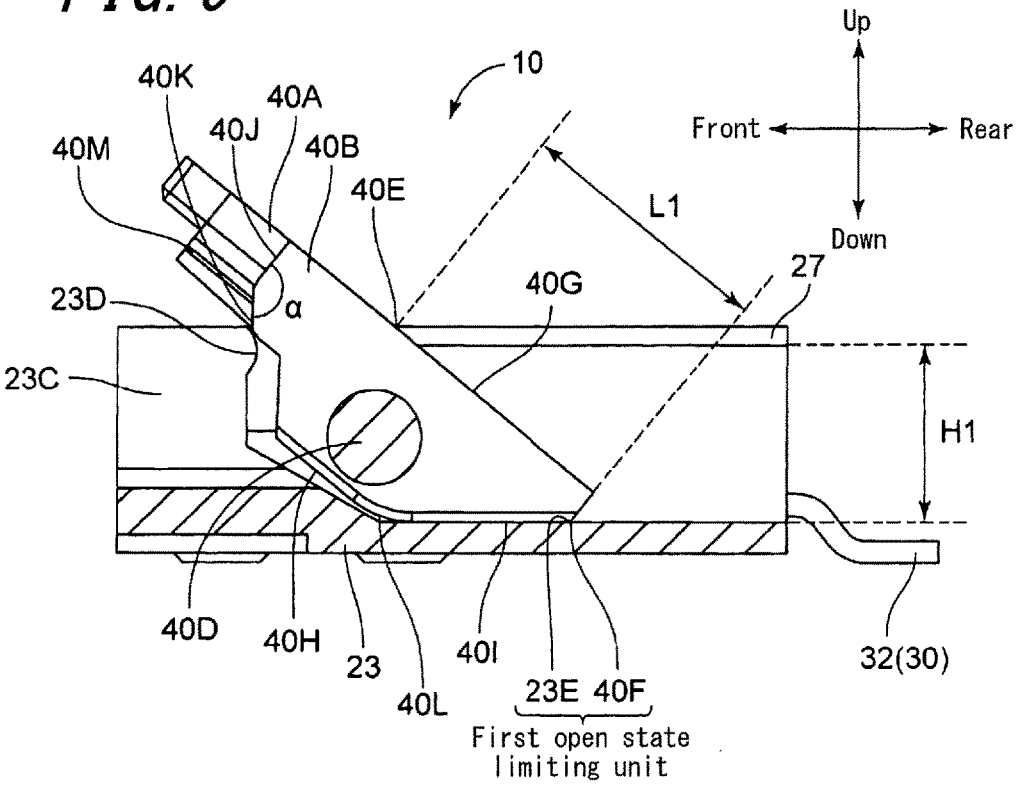
FIG. 9 is a cross-sectional view taken from line IX-IX of FIG. 3.
Figure 10:
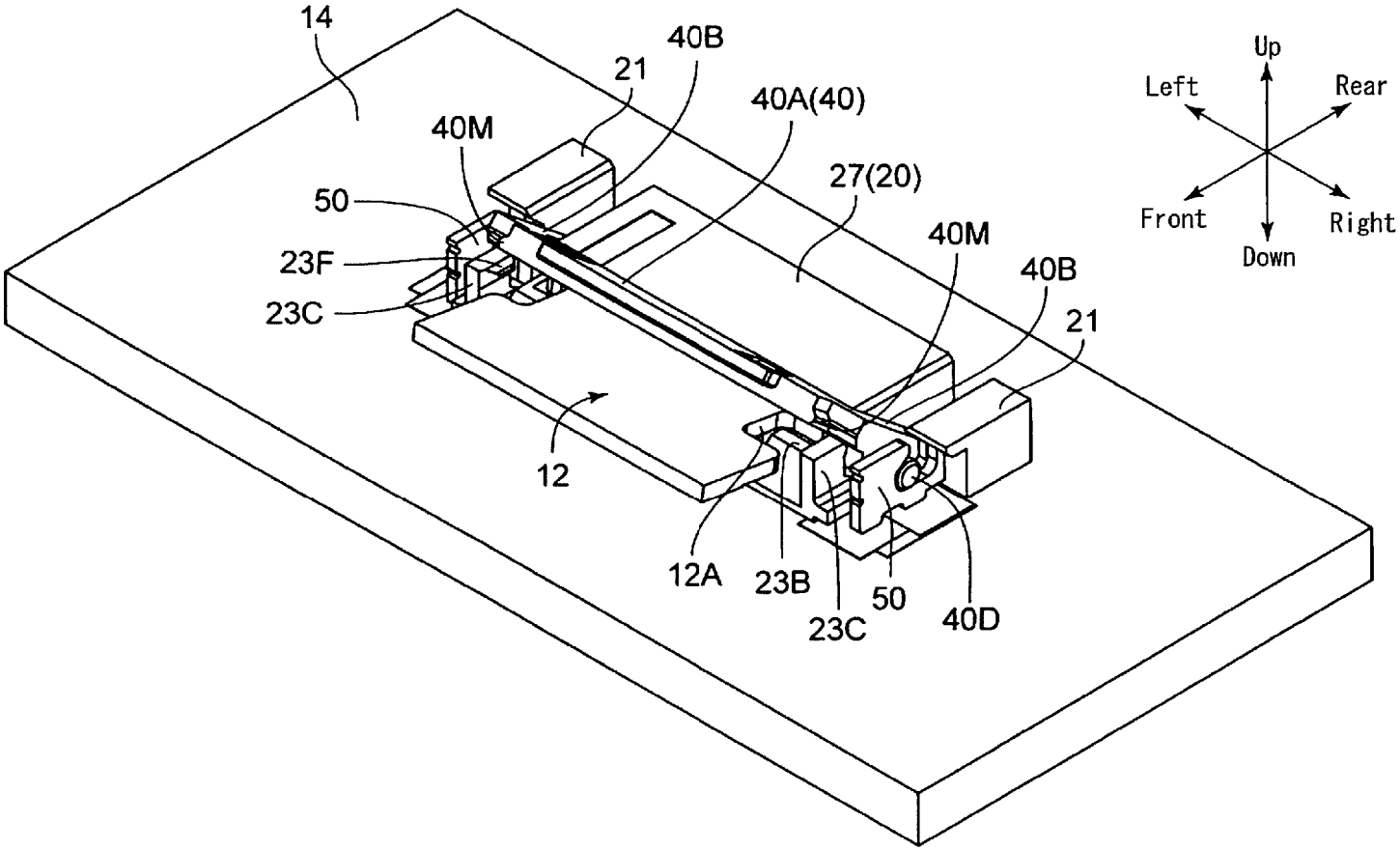
FIG. 10 is a first diagram illustrating the mounting of the connector and the connection of a connection object to the connector.

When a person inadvertently applies an excessive force to cause a backward-falling state when the actuator 40 is appropriately in the open state, the rear abutments 40F of the inclined portions 40I of the pair of arms 40B of the actuator 40 and the supporting abutments 23E formed on the bottom plate 23 of the insulator 20 contact each other as illustrated in FIG. 9, thus restricting a maximum opening angle of the actuator 40 (i.e., preventing the actuator 40 from opening further). That is, the rear end abutments 40F of the actuator 40 and the supporting abutments 23E of the insulator 20 together constitute a "first open state restriction unit" configured to restrict transition of the actuator 40 from the closed state to the open state.

As illustrated in FIG. 12, the recess 40C formed on the rear end 40E of the actuator base portion 40A (the pressing portion) of the actuator 40 and the projection 27A formed on the front end of the top plate 27 of the insulator 20 engage with (contact) each other, thus restricting the maximum opening angle of the actuator 40 (i.e., preventing the actuator 40 from opening further). That is, the recess 40C of the actuator 40 and the projection 27A of the insulator 20 together constitute a "second open state restriction unit" configured to restrict the transition of the actuator 40 from the closed state to the open state.

Figure 8:
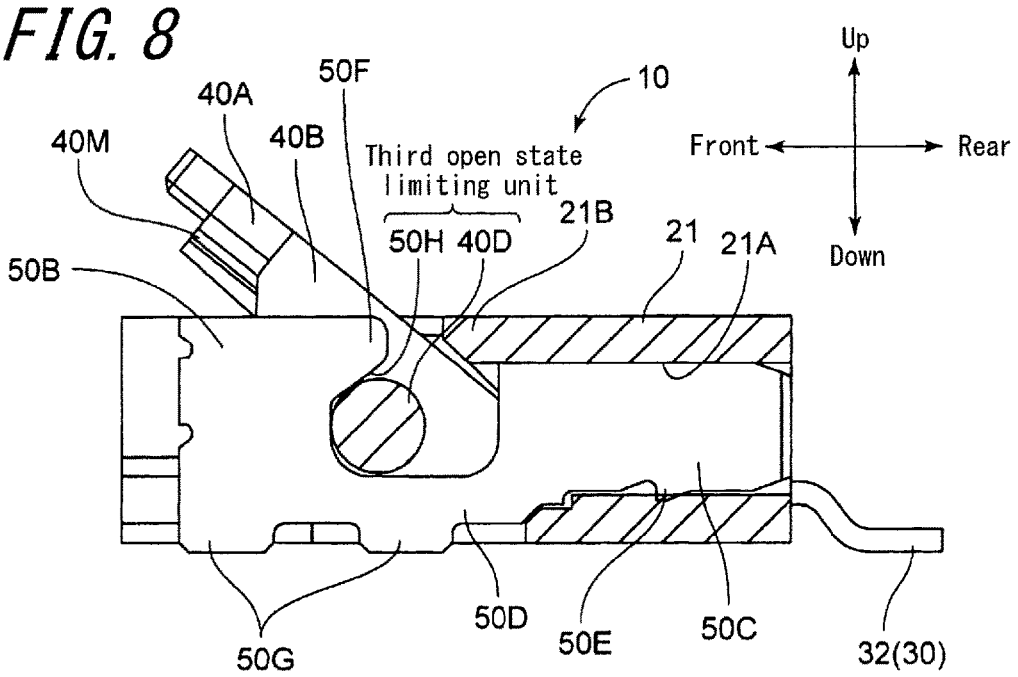
FIG. 8 is a cross-sectional view taken from line VIII-VIII of FIG. 3.

As illustrated in FIG. 8, the movement restriction projection 40D of the actuator 40 and the inclined surface 50H of the retaining bracket 50 contact each other, thus restricting the maximum opening angle of the actuator 40 (i.e., preventing the actuator 40 from opening further). That is, the movement restriction projection 40D of the actuator 40 and the inclined surface 50H of the retaining bracket 50 together constitute a "third open state restriction unit" configured to restrict the transition of the actuator 40 from the closed state to the open state. In particular, facing portions (abutments) between the recess 40C of the actuator 40 and the projection 27A of the insulator 20 are located on an extension line from the inclined surface 50H of the retaining bracket 50. Therefore, the movement restriction projection 40D of the actuator 40 and the inclined surface 50H of the retaining bracket 50 contact each other and move the actuator 40 to the actuator retaining projection 21B of the insulator 20, thus making the recess 40C of the actuator 40 and the projection 27A of the insulator 20 contact each other with greater reliability and strength. In other words, the "second open state restriction unit" and the "third opening restriction units" may restrict the transition of the actuator 40 from the closed state to the open state in a synergistic manner.

As described above, the connector 10 according to the present embodiment restricts the transition of the actuator 40 from the closed state to the open state by using the combination of the rear end abutment 40F of the actuator 40 and the supporting abutment 23E of the insulator 20 (i.e., the first open state restriction unit), the combination of the recess 40C of the actuator 40 and the projection 27A of the insulator 20 (i.e., the second open state restriction unit), and the combination of the movement restriction projection 40D of the actuator 40 and the inclined surface 50H of the retaining bracket 50 (i.e., the third open state restriction unit). Accordingly, when a person inadvertently applies an excessive force in an opening direction of the actuator 40 when the actuator 40 is in the open state, the actuator 40 is prevented from opening further. That is, the connector 10 may prevent breakage or dislocation of the actuator 40.

As illustrated in FIG. 9, also, the distance L1 between the rear end 40E on a rear side (an insertion direction side) of the actuator base portion 40A (the pressing portion) of the actuator 40 and the rear end abutments 40F of the pair of arms 40B is set to be longer than a distance H1 between the top surface of the connection object accommodating section 20A and the supporting abutment 23E of the insulator 20. That is, a distance between the rear end 40E (a working point) of the actuator base portion 40A and the rear end abutment 40F (a fulcrum) of the arm 40B are set to be long. Thus, the connector 10 may effectively restrict an opening movement of the actuator 40 while reducing the load on the actuator 40.

As illustrated in FIG. 9, further, the rear end abutment 40F is at least partially located farther in the insertion direction (rearward) of the connection object 12 than the rear end 40E (or the accommodating opening 20B) in the insertion direction of the actuator base portion 40A (the pressing portion). This enables the connector 10 to set the maximum opening angle of the actuator 40 to be an acute angle sufficiently smaller than 90 degrees. Accordingly, the connector 10 may reliably prevent the breakage or dislocation of the actuator 40 when the actuator 40 is forced to open over the maximum opening angle at the acute angle.

Figure 6:
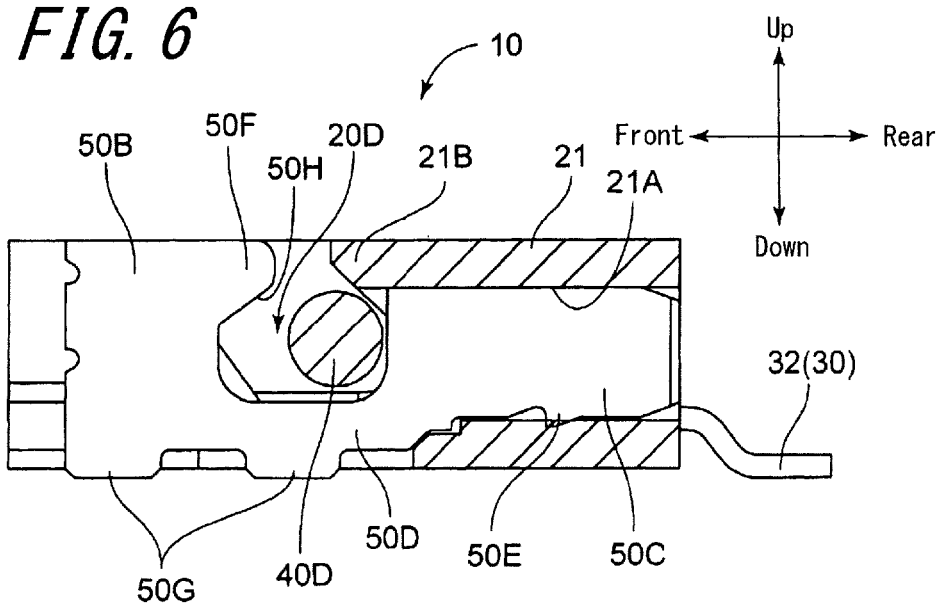
FIG. 6 is a cross-sectional view taken from line VI-VI of FIG. 1.

As illustrated in FIG. 6 and FIG. 7, when the actuator 40 is in the closed state, the pair of arms 40B (the rear end abutments 40F) of the actuator 40 is spaced apart from the bottom plate 23 of the insulator 20. That is, the rear end abutments 40F of the actuator 40 and the supporting abutment 23E of the insulator 20 are not in contact with each other.

To attach the actuator 40 to the insulator 20, first, a rear end of the insertion portion 50C of the retaining bracket 50 is (provisionally) pressed into the fitting bracket locking hole 21A. At this point, a distance between the rear end of the actuator retaining projection 50F and a front end of the actuator retaining projection 21B of the fitting bracket locking block 21 is longer than the diameter of the movement restriction projection 40D. Next, the pair of movement restriction projections 40D are fitted from above in the cutouts 50A of the pair of the retaining brackets 50, are provisionally pressed into the fitting bracket locking hole 21A, and the pair of arms 40B is disposed in the pair of arm accommodating recesses 20C. Then, the inserted portion 50C of the retaining bracket 50 is further (fully) pressed deep (rearward) into the fitting bracket locking hole 21A. At this point, the rear end of the actuator retaining projection 50F and the front end of the actuator retaining projection 21B of the fitting bracket locking block 21 face each other with a space therebetween smaller than the diameter of the movement restriction projection 40D having the cylindrical shape. In this way, the movement restriction projection 40D is located in the movement restriction hole 20D surrounded by the fitting bracket base portion SOB, the connecting portion 50D, the insertion portion 50C, and the actuator retaining projection 21B (see FIG. 6), thus restricting a movement of the movement restriction projection 40D within the movement restriction hole 20D. The movement restriction projection 40D is loosely fitted in the movement restriction hole 20D, thus enabling the actuator 40 to slide (shift) and rotate. As described above, the movement restriction projection 40D is loosely fitted in the movement restriction hole 20D, and the actuator 40 does not have a rotary axis.

Transition of Actuator 40 from Open State to Closed State

In the open state, the actuator 40 is inclined in the removal direction of the connection object 12. At this point, the second guided portion 40K of the arm 40B of the actuator 40 contacts the guiding surface 23D of the insulator 20 as illustrated in FIG. 9. That is, in the open state, the actuator 40 is leaning against the guiding surface 23D at the second guided portion 40K. This increases a resisting force from the guiding surface 23D to the second guided portion 40K, increasing a frictional force between the guiding surface 23D and the second guided portion 40K. Unless an external force is applied to the actuator 40 in its closing direction, the frictional force prevents the transition of the actuator 40 from the open state to the closed state. That is, the connector 10 may stably maintain the actuator 40 in the open state. Also, in the open state the ridge 40L (the curved portion) connecting between the bottom surface 40H of the actuator 40 and the inclined surface 40I contacts the top surface of the bottom plate 23 of the insulator 20.

In response to an external force applied to the actuator 40 in the closing direction, the actuator 40 starts the transition from the open state to the closed state. In an initial stage of the transition from the open state to the closed state, the second guided portion 40K is guided to slide downward and rearward while contacting the guiding surface 23D. Along with this, the ridge 40L (the curved portion) starts sliding rearward on the top surface of the bottom plate 23, and the movement restriction projection 40D starts sliding rearward on the top surface of the connecting portion 50D of the retaining bracket 50 in a restricted manner. As a result, the actuator 40 rotates from the open state to the closed state and slides rearward. The ridge 40L and the movement restriction projection 40D each have a curved shape, which is utilized to slide on the top surface of the bottom plate 23 and the top surface of the connecting portion 50D of the retaining bracket 50. Thus, the actuator 40 may perform smooth transition from the open state to the closed state.

When the transition from the open state to the closed state proceeds further, the engaging projection 40M of the actuator base portion 40A of the actuator 40 engages with the engaging projection 23F of the insulator 20. Thus, the actuator 40 becomes fully closed.

Transition of Actuator 40 from Closed State to Open State

In the transition of the actuator 40 from the closed state to the open state, the movement restriction projection 40D of the actuator 40 slides forward on the top surface of the connecting portion 50D of the retaining bracket 50 in a restricted manner, and rotates from the closed state to the open state. When the actuator 40 opens in this manner, the rear end abutment 40F of the actuator 40 and the supporting abutment 23E of the insulator 20 (i.e., the first open state restriction unit), the recess 40C of the actuator 40 and the projection 27A of the insulator 20 (i.e., the second open state restriction unit), and the movement restriction projection 40D of the actuator 40 and the inclined surface 50H of the retaining bracket 50 (i.e., the third open state restriction unit) together restrict the transition of the actuator 40 from the closed state to the open state.

As described above, in the connector 10 according to the present embodiment the actuator 40 is located either lateral side of the accommodating section 20A and, also, includes the pair of arms 40B extending in the insertion-removal direction of the connection object 12 from either end of the pressing portion 40A. Further, the pair of arms 40B and the insulator 20 include the first open state restriction unit (40F and 23E) configured to restrict the opening angle of the actuator 40 from the closed state to the open state. Thus, the connector 10 may prevent the breakage or dislocation of the actuator 40 when an excessive force acting in the opening direction of the actuator 40 is applied to the actuator 40.

Also, in the connector 10 according to the present embodiment the maximum opening angle of the actuator 40 is set to be smaller than 90 degrees and, further, the rear end abutment 40F of the actuator 40 and the supporting abutment 23E of the insulator 20 (i.e., the first open state restriction unit), the recess 40C of the actuator 40 and the projection 27A of the insulator 20 (i.e., the second open state restriction unit), and the movement restriction projection 40D of the actuator 40 and the inclined surface 50H of the retaining bracket 50 (i.e., the third open state restriction unit) together restrict the transition of the actuator 40 from the closed state to the open state. Thus, when a relatively large force (a force pressing the connector from above) pressing the actuator 40 in the closing direction is applied during assembly by the automated assembling machine, the connector 10 is capable of readily and reliably guiding the actuator 40 in the closing direction by moving (sliding and rotating) the actuator 40 by applying a small force thereto. Further, when receiving a large force pressing the actuator 40 in the closing direction, the connector 10 is capable of releasing (dispersing) the force without fully receiving the force. Thus, the breakage or dislocation of actuator 40 may be prevented.

In the above embodiment, the rear end abutment 40F of the actuator 40 and the supporting abutment 23E of the insulator 20 (i.e., the first open state restriction unit), the recess 40C of the actuator 40 and the projection 27A of the insulator 20 (i.e., the second open state restriction unit), and the movement restriction projection 40D of the actuator 40 and the inclined surface 50H of the retaining bracket 50 (i.e., the third open state restriction unit) are provided, by way of example. However, the present disclosure does not need to include all of them and may include, for example, the "first open state restriction unit", omitting the "second open state restriction unit" and/or the "third open state restriction unit".

REFERENCE SIGNS LIST

10 connector
12 connection object
12A engaging cutout (positioning cutout)
14 substrate
20 insulator
20A connection object accommodation section (accommodation section)
20B accommodation opening
20C arm accommodation recess
20D movement restriction hole
21 fitting bracket locking block
21A fitting bracket locking hole
21B actuator retaining projection
23 bottom plate (housing portion)
23A contact locking groove
23B retaining projection
23C guiding projection
23D guiding surface
23E supporting abutment (first open state restriction unit)

23F engaging projection
25 lateral portion (housing portion)
27 top plate (housing portion)
27A projection (second open state restriction unit)
29 rear surface (housing portion)
29A contact insertion hole
30 contact
32 mounting portion
34 elastic deformable portion
36 contact projection
40 actuator
40A actuator base portion (pressing portion)
40B arm
40C recess (second open state restriction unit)
40D movement restriction projection (third opened state restriction unit)
40E rear end (top end in insertion direction)
40F rear end abutment (first open state restriction unit)
40G upper portion
40H lower portion
40I inclined portion
40J first guided portion
40K second guided portion
40L ridge (curved portion)
40M locking projection
40N left and right ends
50 retaining bracket
50A cutout
50B fitting bracket base portion
50C inserted portion
50D connecting portion
50E locking projection
50F actuator retaining projection
50G mounting portion
50H inclined surface (third open state restriction unit)

The invention claimed is:

1. A connector comprising:

an insulator including an accommodation section with an accommodation opening, the insulator being configured to allow insertion of a connection object through the accommodation opening;

a contact supported by the insulator and electrically connectable to the connection object in the accommodation section; and an actuator that is supported by the insulator in an openable and closable manner, enables insertion of the connection object through the accommodation opening when in an open state, and includes a pressing portion configured to press the connection object in the accommodation section to the contact when in a closed state, wherein the actuator includes a pair of arms located on either side of the accommodation section and extending in an insertion direction of the connection object from either lateral end of the pressing portion, and the pair of arms and the insulator include a first open state restriction unit configured to restrict an opening angle of the actuator from the closed state to the open state, wherein the first open state restriction unit is configured with a pair of abutments provided to the pair of arms and the insulator, the pair of abutments being configured to contact each other when the actuator is in the open state to restrict the opening angle of the actuator, and wherein the abutments of the pair of arms are at least partially located farther in the insertion direction of the connection object than a top end of the pressing portion in the insertion direction.

2. The connector according to claim 1, wherein the pair of abutments of the first open state restriction unit do not contact each other when the actuator is in the closed state.

3. The connector according to claim 1, wherein a distance between the top end of the pressing portion in the insertion direction and the abutments of the pair of arms is set to be longer than a distance between a top surface of the accommodation section and the abutment of the insulator.

4. The connector according to claim 1, wherein the pressing portion and the insulator include a second open state restriction unit configured to restrict the opening angle of the actuator from the closed state to the open state.

5. The connector according to claim 4, wherein the second open state restriction unit is configured with a recess formed on the pressing portion and a projection formed on the insulator that are facing each other.

6. The connector according to claim 1, wherein a lateral projection protruding in a lateral direction from the pair of arms is formed on the pair of arms of the actuator, and the insulator is supported by a retaining bracket that is configured to accommodate the lateral projections of the pair of arms and to enable the actuator to rotate and slide relative to the insulator.

7. The connector according to claim 6, wherein the lateral projection and the retaining bracket include a third open state restriction unit configured to restrict the opening angle of the actuator from the closed state to the open state.

8. The connector according to claim 7, wherein the third open state restriction unit is configured with the lateral projection and an inclined surface that is formed on the retaining bracket and remote farther from a bottom surface of the accommodation section as located farther in the insertion direction.

9. The connector according to claim 1, wherein the connection object includes a positioning recess formed thereon, and the insulator includes a positioning projection to fit in the positioning recess when the actuator is in the closed state.

* * * * *